US005842499A

United States Patent [19]

Hall

[11] Patent Number: 5,842,499

[45] Date of Patent: Dec. 1, 1998

[54] DRAINING DEVICE FOR A FREEZE-RESISTANT FAUCET

[76] Inventor: Kelly L. Hall, 6734 Gooch Hill Rd., Bozeman, Mont. 59715

[21] Appl. No.: 611,251

[22] Filed: Mar. 5, 1996

[51] Int. Cl.[6] ..... F16L 5/00

[52] U.S. Cl. ..... 137/360; 137/312; 137/375

[58] Field of Search ..... 137/360, 312, 137/801, 375

[56] References Cited

U.S. PATENT DOCUMENTS 4,158,366 6/1979 Van Meter .
4,314,580 2/1982 Steinwand .
4,473,244 9/1984 Hill .
4,475,570 10/1984 Pike et al. ..... 137/360
4,538,637 9/1985 Williams .
4,836,237 6/1989 McCullough .

*Primary Examiner*—A. Michael Chambers
*Attorney, Agent, or Firm*—Richard C. Conover

[57] ABSTRACT

A drain system for use with a conventional freeze-resistant faucet installed in a building structure including an elongate tubular housing surrounding the feed conduit associated with the freeze-resistant faucet. The housing has a fitting at one end for connecting with the water supply. A hollow plug of cylindrical shape being connected to the water supply end of the feed conduit. The hollow plug further includes an "O" ring seal on its exterior surface sized to fit snugly within the elongate housing when the feed conduit together with the hollow plug are inserted in the housing. Water from a ruptured feed conduit is collected within the housing and directed to the outside of the building structure.

4 Claims, 3 Drawing Sheets

DRAINING DEVICE FOR A FREEZE-RESISTANT FAUCET

BACKGROUND OF THE INVENTION

The present invention relates to a draining device for a freeze-resistant faucet and more specifically to an encompassing housing which diverts water from a rupture in a conventional freeze-resistant faucet to an exterior surface of a building. Freezing of outside faucets has always been a problem. Freeze-resistant faucets have been developed to solve this problem. Conventional freeze-resistant faucets include a outside faucet which has a threaded hose-attaching end. A water cut-off valve is spaced considerably apart from the exterior portion so as to remain within the heated interior of the house. The hose-attaching end and cut-off valve are connected with a water feed conduit. A recognized problem when using these conventional freeze-resistant faucets is that the feed conduit can freeze and rupture when, for example, a hose is left connected to the faucet during freezing weather. Water to the hose is shut off at the faucet and at the cut-off valve leaving water in the feed conduit which is subject to freezing.

Several patents have issued which address the problem of diverting water from freezing feed conduits. U.S. Pat. No. 4,314,580 to Steinwand illustrates a housing surrounding the feed conduit to catch water when the feed conduit ruptures, but this housing only contains the water and does not drain water out of the housing. Further, in replacing the ruptured feed conduit only the feed conduit pipe is removed leaving the water cut-off valve in place inside the housing. U.S. Pat. No. 4,836,237 to McCullough illustrates a tubular drain housing surrounding the feed conduit. This device provides a visual indication that the feed conduit has ruptured but does not provide for easy replacement of the ruptured feed conduit. U.S. Pat. No. 4,473,244 to Hill illustrates a housing surrounding the feed conduit. The housing is clamped to a water supply pipe and a freeze-resistant faucet in threadably secured to the water supply pipe. While this device may be easily installed, it is difficult to remove the freeze-resistant faucet to repair or replace a ruptured feed conduit.

All of the above listed patents illustrate devices where the feed conduit is surrounded by a housing to collect water from a ruptured feed conduit. However, with all of these known devices it is not a simple matter to remove a conventional freeze-resistant faucet for repair or maintenance. What is needed is a device which permits all the parts of a freeze-resistant faucet to be removed easily, when necessary, so that any part can be repaired or replaced without relying upon seals that cannot be repaired or replaced after installation.

SUMMARY OF INVENTION

The present invention is used with a conventional freeze-resistant faucet and includes an elongate tubular housing surrounding the feed conduit associated with a conventional freeze-resistant faucet having a threaded fitting distal from the faucet end for conventionally attaching the feed conduit to the water supply pipe. A freeze-resistant faucet is conventionally installed with a gentle slope downward toward the exterior wall to drain water in the feed conduit once the faucet is closed. The tubular housing of the present invention also slopes downwardly toward the exterior wall so that any water dripping into the housing can then drain outwardly away from the exterior wall. At the interior end of the housing, a fitting is provided to connect the housing to the building's water supply.

The present invention includes a hollow plug, of cylindrical shape, having an interior bore along the longitudinal axis providing fluid communication from one end to the other. One end of the bore has a threaded interior to accept the threaded fitting of the feed conduit. The feed conduit is thus connected to the hollow plug rather than the conventional connection with the water supply pipe. The hollow plug includes an "O" ring seal on its exterior surface and is also sized to fit snugly within the elongated housing so as to prevent water from the water supply from seeping around the exterior of the hollow plug. Instead water from the supply is directed through the hollow plug into the feed conduit and thence to the faucet.

To install the present invention, a hole is prepared in the outside wall of the building structure and the tubular housing inserted through the wall. The housing is then attached to the water supply as by soldering. Next the hollow plug is threaded on the feed conduit of a conventional freeze-resistant faucet and the entire freeze-resistant faucet with the hollow plug attached inserted from the outside of the building structure into the housing. A face plate is attached to the outside wall to hold the structure in place.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
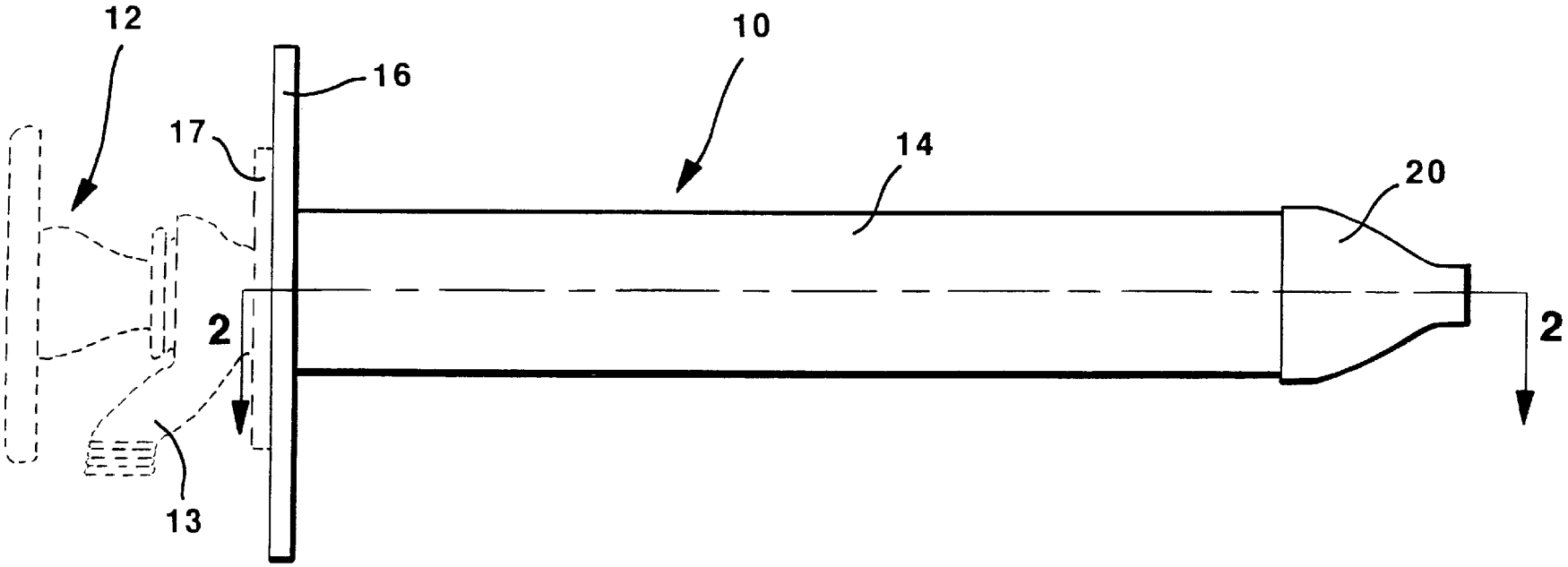
FIG. 1 is an elevational view of a draining device for a freeze-resistant faucet according to the present invention, the freeze-resistant faucet is shown in phantom.
Figure 2:
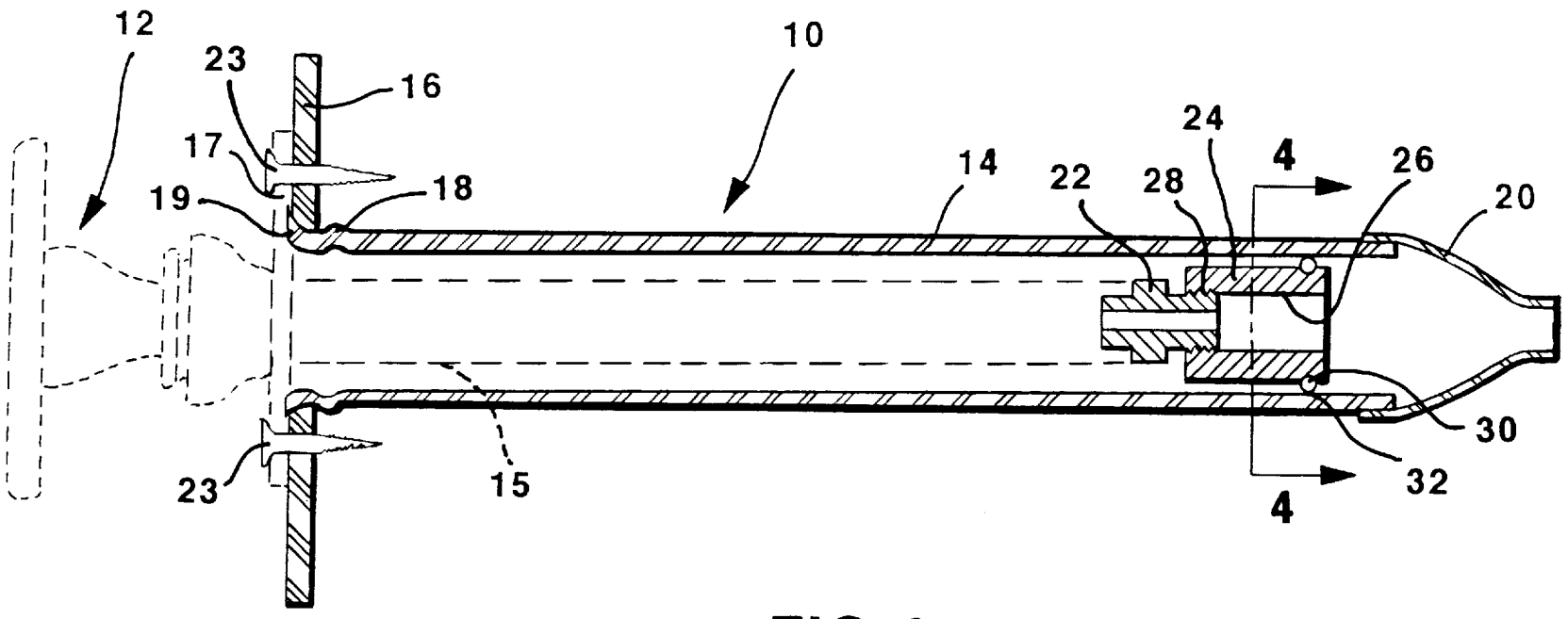
FIG. 2 is a cross-sectional view of the present invention along line 2—2 in FIG. 1.
Figure 3:
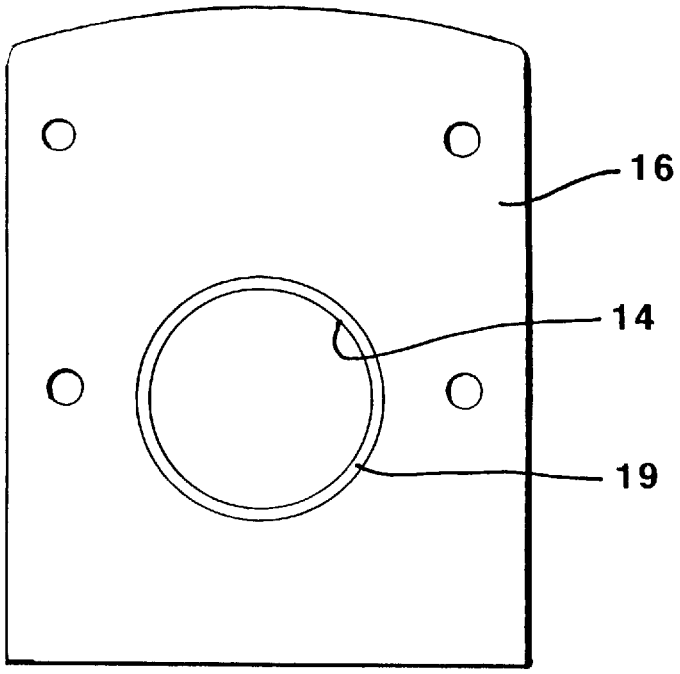
FIG. 3 is a side view of the draining device shown in FIG. 1 with the freeze-resistant faucet removed.
Figure 4:
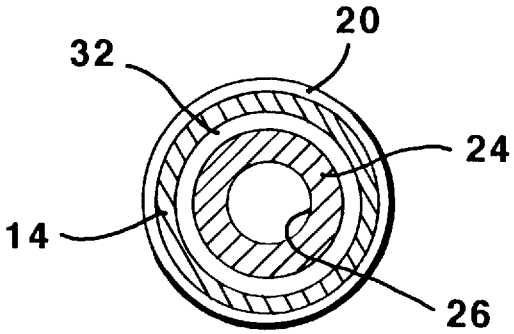
FIG. 4 is a cross-sectional view of the draining device for a freeze-resistant faucet taken along the line 4—4 in FIG. 2.

A preferred embodiment of the draining device 10 for use with a conventional freeze-resistant faucet 12 is shown in FIG. 1. The freeze-resistant faucet 12 includes a faucet 13 attached to a feed conduit 15. At one end of draining device 10, an attaching plate 16 is provided which can be attached to an external wall of a building. On one side of attaching plate 16, dimples 18 are punched into tubular housing 14 so as to hold attaching plate 16 at this end of the tubular housing. On the other side of attaching plate 16, tubular housing 14 has a flared end 19 to hold the attaching plate onto the tubular housing.

At the other end of tubular housing 14, a size changing fitting 20 is attached as by soldering. Size changing fitting 20 changes the tube size from a water supply pipe (not shown) size to the outside diameter of tubular housing 14 which is significantly larger then the feed conduit 15 of conventional freeze-resistant faucet 12. The fitting 20 is connected to the water supply pipe as by soldering to allow water from the water supply to be directed to the interior of the housing 14.

The feed conduit 15 has a threaded fitting 22 at an end of feed conduit 15 distal from faucet 13. Fitting 22 has an internal bore to provide fluid communication through the fitting to allow water from the water supply to reach faucet 13. A cut-off valve (not shown) is provided in freeze-resistant faucet 12 at a location adjacent the fitting 22.

A hollow plug 24, which has a cylindrical shape, has an interior bore 26 which is internally threaded at one end. The threaded end of interior bore 26 mates with the threads on threaded fitting 22 so that the plug can be screwed onto the feed conduit 15. The combination provides for an interior passageway for water to pass from the water supply through the change fitting 20, then through the hollow plug on to the cut-off valve of the freeze-resistant faucet 12 and then into the feed conduit 15.

At the end of hollow plug 24 opposite the threaded end, a groove 30 is cut on an outside circumference of the plug. Groove 30 is sized to hold "O" ring 32 which is sized to provide a water tight fit when inserted into the interior of tubular housing 14. "O" ring 32 prevents water from the water supply from bypassing hollow plug 24. Instead water is directed in the feed conduit 15.

The freeze-resistant faucet 12 is provided with a face plate 17. A fastening means 23 is used to fasten the face plate 17 and attaching plate 16 to the exterior wall of a building structure so that internal pressure against hollow plug 24 and the cut-off valve will not force the freeze-resistant faucet 12 out of tubular housing 14. Once water pressure to the water supply is cut off, freeze-resistant faucet 12, with hollow plug 24 attached, can be pulled out of tubular housing 14 as one unit. The only thing remaining in the building when this is done is tubular housing 14 with its attaching plate 16 and size changing fitting 20.

When installing the present invention in a building structure, a hole is drilled through an outside wall with a diameter selected to fit around the tubular housing 14. The hole is drilled to have a gentle slope downwardly towards the outside wall. The tubular housing 14 is then inserted in the hole with the fitting 20 located inside the wall. The fitting 20 is then connected to a water supply pipe as by soldering. Next the plug 24 is threaded onto the feed conduit of a conventional freeze-resistant faucet 12. The feed conduit together with the plug 24 are inserted into the housing 14. The face plate 17 and attaching plate 16 are then secured to the outside wall with screws 23.

As the handle of freeze-resistant faucet 12 is operated, water can flow from the water supply through fitting 20, then hollow plug 24 into feed conduit 15 through the water cut-off valve and then out the faucet 13.

If the feed conduit 15 ruptures due to water being left in the feed conduit, water from feed conduit 15 is collected in housing 14 and then drains outside the housing just inside of face plate 17. The "O" ring seal 32 prevents water from the water supply from bypassing the plug 24 on the outside of the plug 24.

Whenever desired, after shutting off the water supply, the face plate 17 can be removed and the freeze-resistant faucet 12 and the plug 24 can then be withdrawn from housing 14 to be repaired or replaced. The repaired or replaced working unit can then be reinserted in the housing 14 still in place and screws 23 are used to screw face plate 17 and attaching plate 16 to the outside wall.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

I claim:

1. A draining device for use with a freeze-resistant faucet connected to a water supply, the freeze-resistant faucet having a feed conduit with a water supply end adjacent a water cut-off valve comprising:

a tubular housing open at one end and having a fitting at the other end for connecting the housing to the water supply with fluid communication from the water supply to the interior of the housing;

a hollow plug having an end for connecting to the water supply end of the feed conduit to provide fluid communication through the hollow plug to the feed conduit;

the tubular housing sized to receive the feed conduit with the hollow plug attached;

the hollow plug being further provided with sealing means positioned on the exterior surface of the hollow plug to prevent water from the water supply from seeping around the hollow plug to a volume between the feed conduit and the tubular housing;

the feed conduit with attached hollow plug being positioned within the housing with the hollow plug located adjacent the fitting; and means for holding the freeze-resistant faucet within the tubular housing when water pressure from the water supply acts on the hollow plug.

2. The draining device of claim 1 wherein the sealing means includes an "O" ring.

3. A draining device for use with a freeze-resistant faucet connected to a water supply, the freeze-resistant faucet having a feed conduit with an externally threaded end adjacent a water cut-off valve comprising:

a tubular housing open at one end and having a fitting at the other end for connecting the housing to the water supply with fluid communication from the water supply to the interior of the housing;

a hollow plug having an end with internal threads for threadably receiving the threaded end of the feed conduit;

the tubular housing sized to receive the feed conduit with the hollow plug attached;

the hollow plug being further provided with sealing means positioned on the exterior surface of the hollow plug to prevent water from the water supply from seeping around the hollow plug to a volume between the feed conduit and the tubular housing;

the feed conduit with attached hollow plug being positioned within the housing with the hollow plug located adjacent the fitting; and means for holding the freeze-resistant faucet within the tubular housing when water pressure from the water supply acts on the hollow plug.

4. The draining device of claim 3 wherein the sealing means includes an "O" ring.

* * * * *